US010471727B2

(12) United States Patent
Muraoka et al.

(10) Patent No.: US 10,471,727 B2
(45) Date of Patent: Nov. 12, 2019

(54) LIQUID EJECTING HEAD AND LIQUID EJECTING APPARATUS

(71) Applicant: CANON KABUSHIKI KAISHA, Tokyo (JP)

(72) Inventors: Chiaki Muraoka, Kawaguchi (JP); Yukuo Yamaguchi, Tokyo (JP); Hiromasa Amma, Kawasaki (JP); Takuya Iwano, Inagi (JP); Takeshi Sekino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/154,067

(22) Filed: May 13, 2016

(65) Prior Publication Data

US 2016/0339711 A1 Nov. 24, 2016

(30) Foreign Application Priority Data

May 22, 2015 (JP) ..... 2015-104548

(51) Int. Cl.
*B41J 2/175* (2006.01)
*B41J 29/02* (2006.01)

(52) U.S. Cl.
CPC ..... *B41J 2/17523* (2013.01); *B41J 2/175* (2013.01); *B41J 2/1752* (2013.01); *B41J 2/17509* (2013.01); *B41J 29/02* (2013.01)

(58) Field of Classification Search
CPC .... B41J 2/175; B41J 2/17513; B41J 2/17523; B41J 2/1752
See application file for complete search history.

(56) References Cited

U.S. PATENT DOCUMENTS 4,928,126 A * 5/1990 Asai ..... B41J 2/17513 141/329
5,666,146 A * 9/1997 Mochizuki ..... B41J 2/17513 347/86
5,805,187 A * 9/1998 Sasaki ..... B41J 2/1752 347/86
6,042,216 A 3/2000 Garcia et al.
(Continued)

FOREIGN PATENT DOCUMENTS

JP 2000-238280 A 9/2000
JP 2003-001843 A 1/2003
(Continued)

OTHER PUBLICATIONS

Notification of Reasons for Refusal dated Feb. 19, 2019, in Japanese Patent Application No. 2015-104548.

*Primary Examiner* — Anh T Vo
(74) *Attorney, Agent, or Firm* — Venable LLP

(57) ABSTRACT

A configuration of a liquid ejecting head enables a stable, continuous ink supply with the off-carriage method, even if a force operates in the direction of joint needle insertion and removal. To this end, a joint opening that accepts insertion of a joint needle on a printing apparatus side is placed at a position closer to a joint face between an ejecting head and a sub tank unit than a positioning opening that engages with a positioning member on the printing apparatus side. Consequently, even if external force is produced due to coupling, the force exerted on the joint face that is a weak portion of an inkjet head may be minimized.

8 Claims, 6 Drawing Sheets

(56) References Cited

U.S. PATENT DOCUMENTS

| | | | | |
|---|---|---|---|---|
| 6,582,068 | B2 * | 6/2003 | Ishizawa | B41J 2/175 347/85 |
| 6,715,865 | B2 | 4/2004 | Yamaguchi et al. | |
| 6,824,243 | B2 | 11/2004 | Yamaguchi et al. | |
| 6,905,197 | B2 * | 6/2005 | Suenaga | B41J 2/17509 347/85 |
| 6,913,351 | B2 | 7/2005 | Yamaguchi et al. | |
| 6,957,883 | B2 | 10/2005 | Yamaguchi et al. | |
| 7,070,267 | B2 | 7/2006 | Yamaguchi et al. | |
| 8,113,637 | B2 * | 2/2012 | Yokouchi | B41J 2/175 347/85 |
| 8,113,639 | B2 * | 2/2012 | Kimura | B41J 2/16523 347/84 |
| 8,550,606 | B2 | 10/2013 | Ikebe et al. | |
| 8,888,258 | B2 * | 11/2014 | Kondou | B41J 2/17513 141/329 |
| 8,967,779 | B2 * | 3/2015 | Tsukahara | B41J 2/17 347/49 |
| 9,061,497 | B2 * | 6/2015 | Okubo | B41J 2/17523 |
| 9,156,263 | B2 | 10/2015 | Kodoi et al. | |
| 9,174,454 | B2 | 11/2015 | Tsujiuchi et al. | |
| 2012/0050418 | A1 * | 3/2012 | Tsujiuchi | B41J 2/17509 347/85 |

FOREIGN PATENT DOCUMENTS

| | | | |
|---|---|---|---|
| JP | 2005-074923 | A | 3/2005 |
| JP | 2006-082318 | A | 3/2006 |
| JP | 2012-045805 | A | 3/2012 |
| JP | 2012-071586 | A | 4/2012 |

* cited by examiner

LIQUID EJECTING HEAD AND LIQUID EJECTING APPARATUS

BACKGROUND OF THE INVENTION

Field of the Invention

The present invention relates to a configuration for promptly supplying liquid in a liquid ejecting head.

Description of the Related Art

In a liquid ejecting apparatus such as an inkjet printing apparatus, there is demand for a stable supply of liquid to an ejecting head that ejects the liquid as droplets. Particularly, in a color inkjet printing apparatus that uses multiple ink colors, a supply channel for guiding ink to ejecting elements is provided independently for each ink color, and prompt supply is demanded for each.

Meanwhile, in a serial inkjet printing apparatus, an on-carriage method and an off-carriage method may be adopted as the method of supplying ink to a print head. The on-carriage method refers to a format of mounting an ink tank that supplies ink to an ejecting head on a carriage that moves inside the apparatus together with the ejecting head. On the other hand, the off-carriage method refers to a method of affixing a main ink tank at a designated location in the apparatus, and supplying ink through a flexible tube to an ejecting head that moves together with the carriage. In the case of a comparatively large-scale printing apparatus, the on-carriage method has a risk of imposing too great a load on the carriage bearing a high-capacity ink tank, and thus the off-carriage method is often adopted.

Japanese Patent Laid-Open No. 2012-45805 discloses an ink supply configuration for the off-carriage method. FIGS. 6A and 6B are diagrams illustrating the configuration of a joint unit of a sub tank disclosed in Japanese Patent Laid-Open No. 2012-45805. Herein, the sub tank refers to a configuration which includes liquid chambers corresponding to the types of ink, and which is movable together with the carriage while supplying each ejecting head with ink from each liquid chamber.

A joint needle unit 300 is made up of a flat plate, and integrally supports multiple joint needles 302 formed approximately perpendicularly to the flat face. Additionally, by having positioning pins 301*a* and 301*b* arranged on the joint needle unit 300 engage with positioning openings 401*a* and 401*b* on the sub tank side, the multiple joint needles 302 are also inserted into joint openings 402 on the sub tank side. As a result, ink supplied from tubes is made to enter the liquid chambers. Japanese Patent Laid-Open No. 2012-45805 discloses a configuration that increases the positioning accuracy of the individual joint needles and decreases the risk of ink leakage by providing features to the layout of the positioning units 401*a* and 401*b* and the multiple joint needles 302.

However, although the configuration of Japanese Patent Laid-Open No. 2012-45805 achieves increased positional accuracy of the joint needles in the plane of the joint unit, or in other words a direction perpendicular to the direction of joint needle insertion, the configuration of Japanese Patent Laid-Open No. 2012-45805 does not consider the force produced in the direction of joint needle insertion and removal. For this reason, if the number of ink colors to handle is increased, and the force produced in the direction of joint needle insertion and removal becomes larger, there is a risk of damage to comparatively weak portions, such as the coupling face of the sub tank and the ejecting head, and a risk of seal rupture.

SUMMARY OF THE INVENTION

The present invention has been devised in order to solve the above problems. Thus, an objective thereof is to provide a configuration of a liquid ejecting head enabling a stable, continuous ink supply with the off-carriage method, even if force operates in the direction of joint needle insertion and removal.

According to a first aspect of the present invention, there is provided a liquid ejecting head removably attachable to a printing apparatus provided with a joint needle for supplying liquid and a positioning member for positioning, the liquid ejecting head comprising: an ejecting head unit configured to eject liquid; and a sub tank unit configured to connect and supply liquid to the ejecting head unit through a connection face, wherein a joint opening that accepts insertion of the joint needle and a positioning opening that engages with the positioning member are provided on one side of the sub tank unit, and the joint opening is arranged at a position closer to the connection face than the positioning opening.

According to a second aspect of the present invention, there is provided a liquid ejecting apparatus including a liquid ejecting head removably attachable to a printing apparatus provided with a joint needle for supplying liquid and a positioning member for positioning, and a carriage on which the liquid ejecting head is mounted, the liquid ejecting head comprising: an ejecting head unit configured to eject liquid; and a sub tank unit configured to connect and supply liquid to the ejecting head unit through a connection face, wherein a joint opening that accepts insertion of the joint needle and a positioning opening that engages with the positioning member are provided on one side of the sub tank unit, and the joint opening is arranged at a position closer to the connection face than the positioning opening, and by causing the carriage to move relative to a print medium while causing the liquid ejecting head to eject ink according to print data, an image is printed onto the print medium.

Further features of the present invention will become apparent from the following description of exemplary embodiments (with reference to the attached drawings).

DESCRIPTION OF THE EMBODIMENTS

Figure 1:
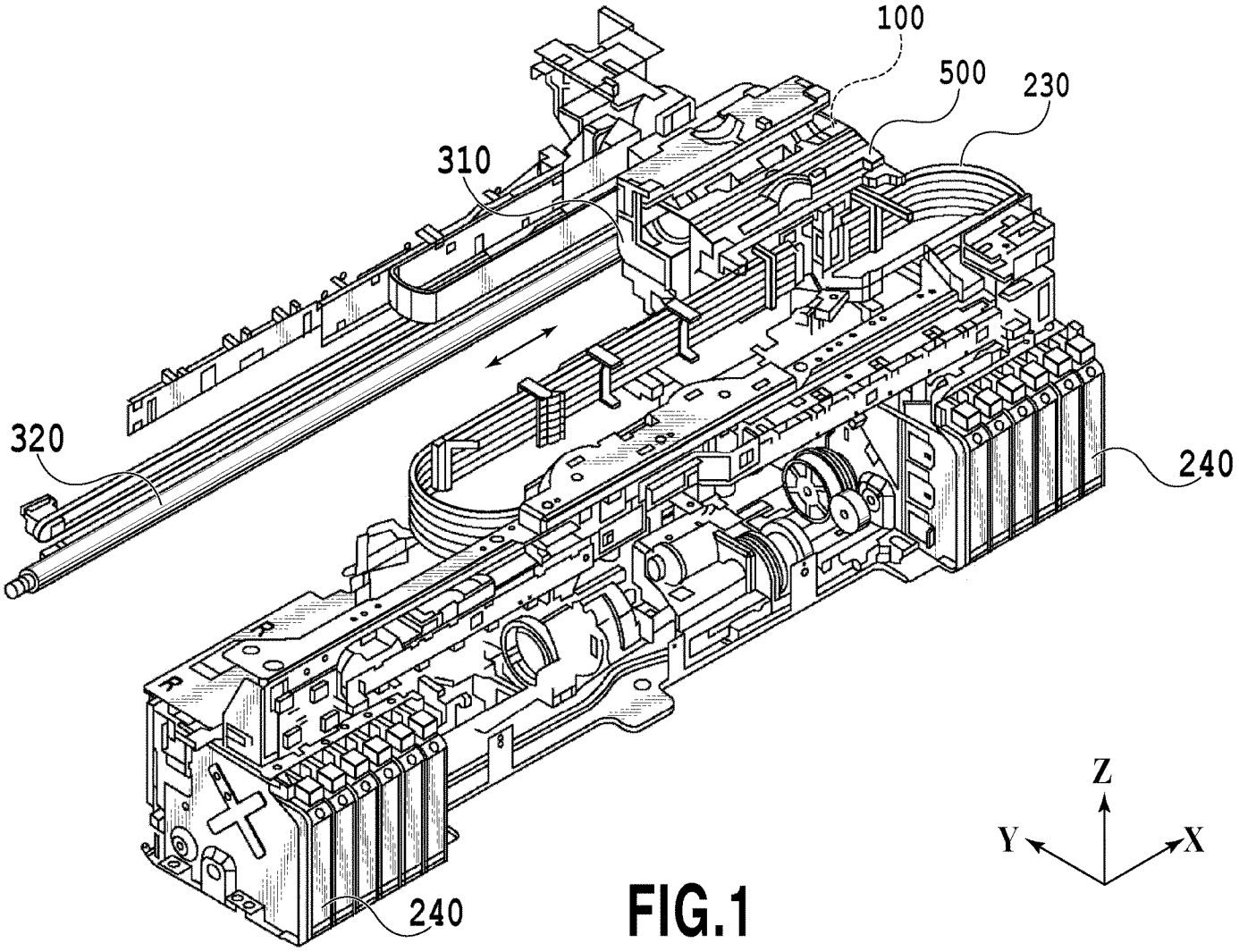
FIG. 1 is an internal configuration diagram of an inkjet printing apparatus.

FIG. 1 is an internal configuration diagram of an inkjet printing apparatus usable as a liquid ejecting apparatus of the present invention. The liquid ejecting apparatus of the exemplary embodiment is taken to be an inkjet printing apparatus capable of ejecting inks of 12 colors, and 12 main tanks 240 for storing each color of ink are disposed on both sides of the device, with six colors per side.

The ink housed in each main tank 240 is supplied through a flexible tube 230 provided for each ink color to a liquid ejecting head (hereinafter designated the inkjet (IJ) head) 100 that is removably mounted onto a carriage 310. The carriage 310 is guided and supported by a shaft 320, and is able to move back and forth along the X direction. Additionally, by repeatedly alternating between a primary scan, in which the IJ head 100 mounted onto the carriage 310 moves in the X direction while ejecting ink in the −Z direction according to print data, and a conveying operation in which the print medium is conveyed in the Y direction, an image is successively formed on the print medium. An amount of ink equal to the ink consumed by the ejecting operations is continuously supplied to the IJ head via the tube 230 and joint needle unit 510 which are able to follow the movements of the carriage 310.

Figure 2:
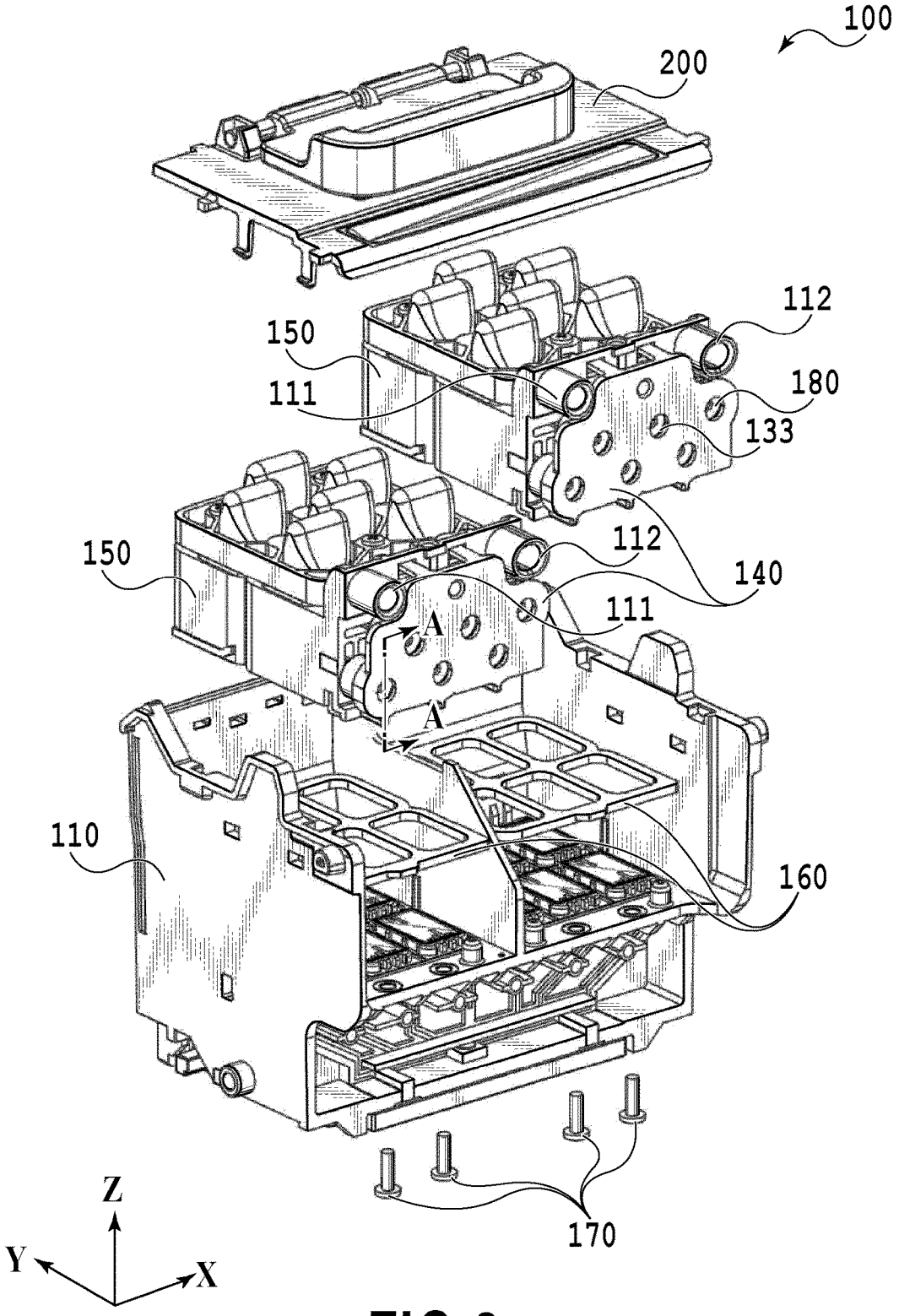
FIG. 2 is an exploded perspective view of an inkjet (IJ) head.

FIG. 2 is an exploded perspective view of the inkjet (IJ) head 100. The IJ head 100 includes an ejecting head unit 110 provided with ejecting elements that eject liquid, a joint seal 160, a sub tank unit 150, and a cap member 200, which are stacked in that order in the Z direction. In the exemplary embodiment, the sub tank unit 150 is made up of two units arranged in the X direction, with each having six liquid chambers corresponding to inks of six colors. The joint seal 160 provided in correspondence with each sub tank unit 150 is made from a rubber member, and couples the openings of the individual liquid chambers in the sub tank unit 150 to flow channel openings for each ink in the ejecting head unit 110. By using screws 170 to couple and fix together the ejecting head unit 110 and the sub tank unit 150 with the joint seal 160 in between, the mixing of liquid and the intrusion of air in between the liquid chambers and the ink flow channels are prevented.

On the −Y side of each sub tank unit 150, a joint cover 140 that receives joint needles 213 discussed later is disposed. On the joint cover 140, joint openings 180 for accepting the insertion of the joint needles 213 are formed in a group of six at designated positions. On the inner side of each joint opening 180, a ring-shaped needle seal 133 that accepts the insertion of and holds a joint needle 213 is disposed. The joint cover 140 collectively holds six needle seals 133 into which the joint needles 213 are inserted directly, and fulfills a role of preventing the joint needles 213 from falling out.

Figure 3A:
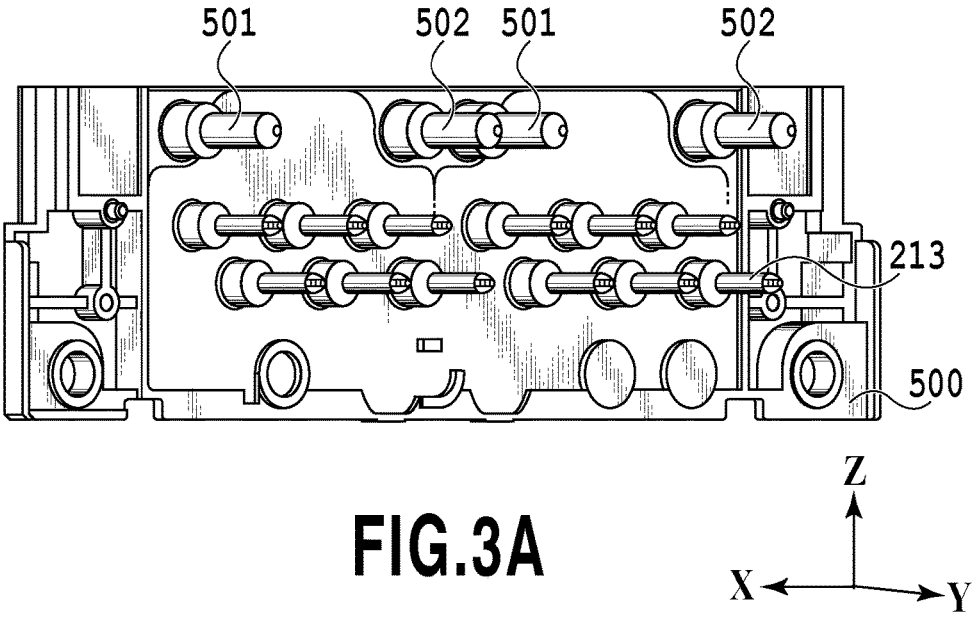
FIGS. 3A and 3B are layout diagrams of a joint cover and a joint needle unit.
Figure 3B:
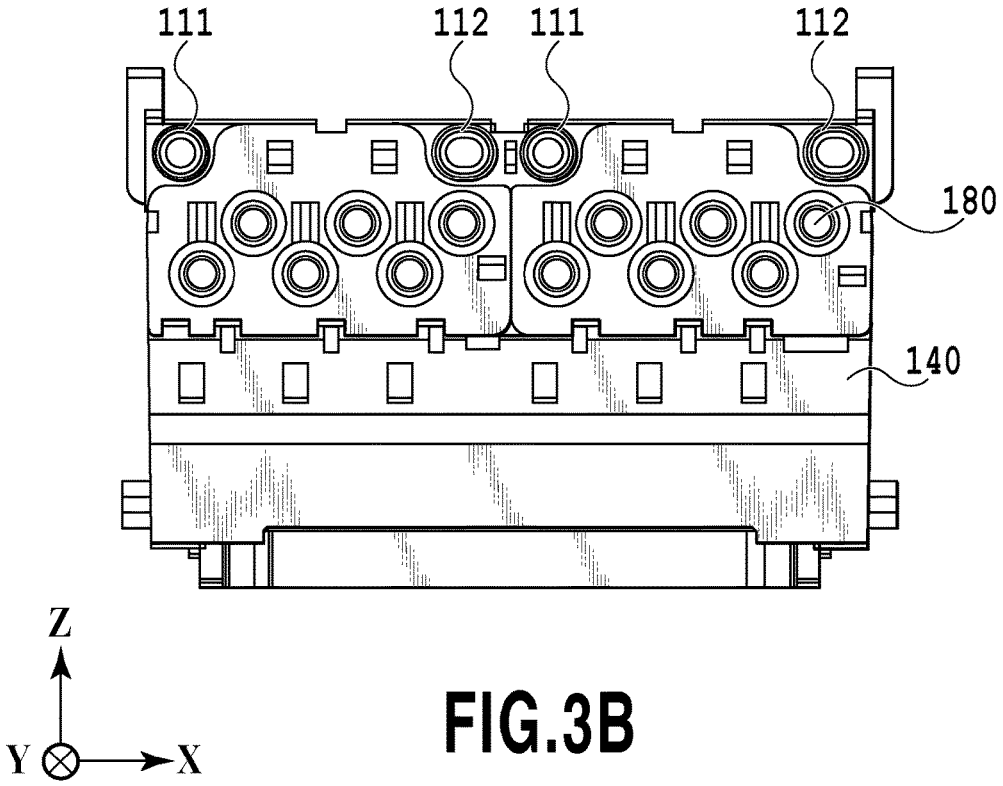

FIG. 3B is a diagram illustrating the joint cover 140 provided on the IJ head 100 of the exemplary embodiment, while FIG. 3A is a diagram illustrating a layout of the joint needle unit 500 provided on the inkjet printing apparatus side that joins with the joint cover 140. As illustrated in FIG. 3B, on one side of the sub tank unit 150, joint openings 180 and positioning openings 111 and 112 are provided. On the joint needle unit 500, joint needles 213 are disposed at positions corresponding to the individual joint openings 180 in an orientation facing opposite the joint cover 140. Also, as a configuration for the relative positioning of the joint needle unit 500 and the joint cover 140, positioning pins 501 and 502, which are positioning members for positioning, are formed on the joint needle unit 500. On the other hand, positioning openings 111 and 112 are formed on the joint cover 140.

In the exemplary embodiment, the positioning opening 111 on one side is a round hole of approximately the same diameter as the positioning pin 501 of the joint needle unit 500. The positioning opening 112 on the other side is an elongated hole or slot having a minor axis diameter of approximately the same diameter as the positioning pin 502 of the joint needle unit 500. This creates a mechanism in which, by joining together with the positioning pins 501 and 502 facing the positioning openings 111 and 112, each joint needle 213 also engages with each corresponding joint opening 180, and the respective parts formed on the same plane become fixed at designated positions.

Figure 4:
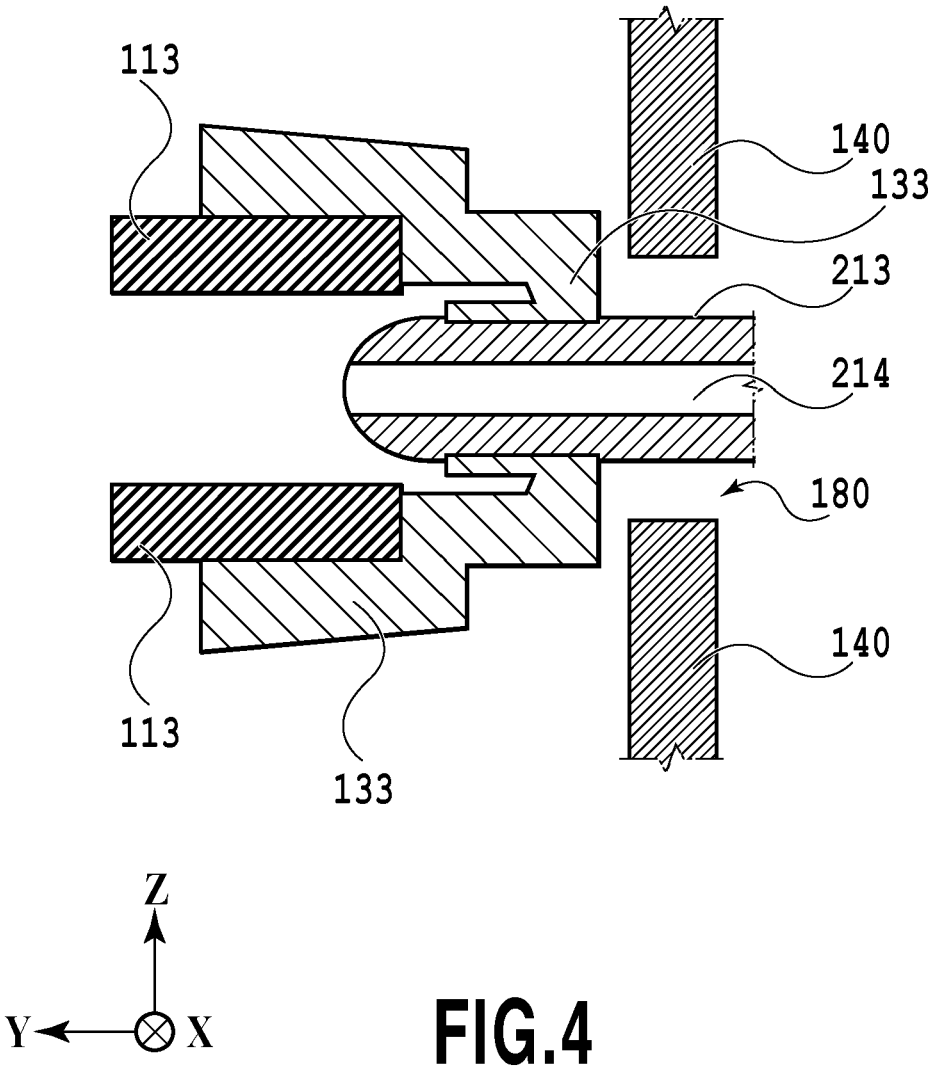
FIG. 4 is a cross-sectional view illustrating a connected state between a joint needle and a joint seal.

FIG. 4 is a cross-sectional view illustrating a connected state between one joint needle 213 and needle seal 133. The joint needle 213 advances in the +Y direction inside the joint opening 180 of the joint cover 140, and reaches the needle seal 133. The needle seal 133 is made of a ring-shaped rubber member, with an inner diameter that is less than the outer diameter of the joint needle 213. Thus, by inserting the joint needle 213, the needle seal 133 is pushed outward to fit around the outer circumference of the joint needle 213. Consequently, a connection of an ink supply system is established, in which ink supplied from the joint needle 213 flows in the +Y direction, while the intrusion of substances such as air and ink leakage are minimized. Meanwhile, the needle seal 133 is also subjected to force in the Y direction due to friction with the joint needle 213. For this reason, a force in the Y direction is also exerted on a needle seal holding part 113 that supports the needle seal 133.

Figure 6A:
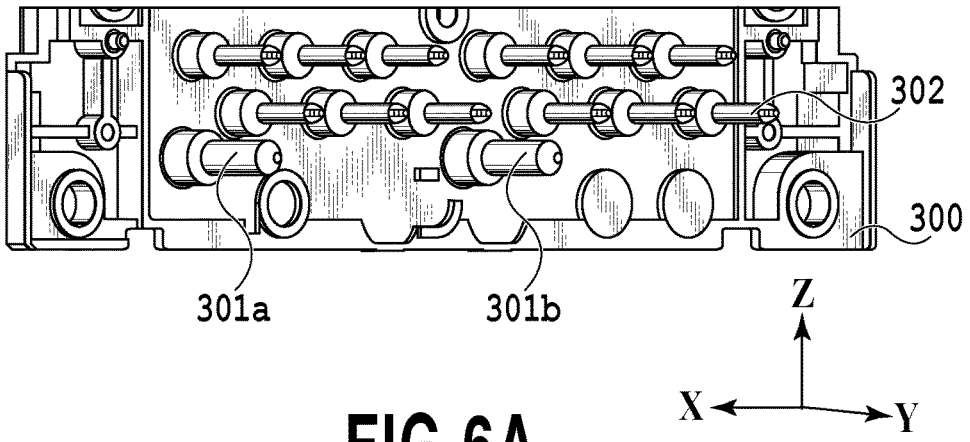
FIG.6A PRIOR ART
FIGS. 6A and 6B are diagrams illustrating a configuration of a joint unit according to Japanese Patent Laid-Open No. 2012-45805.
Figure 6B:
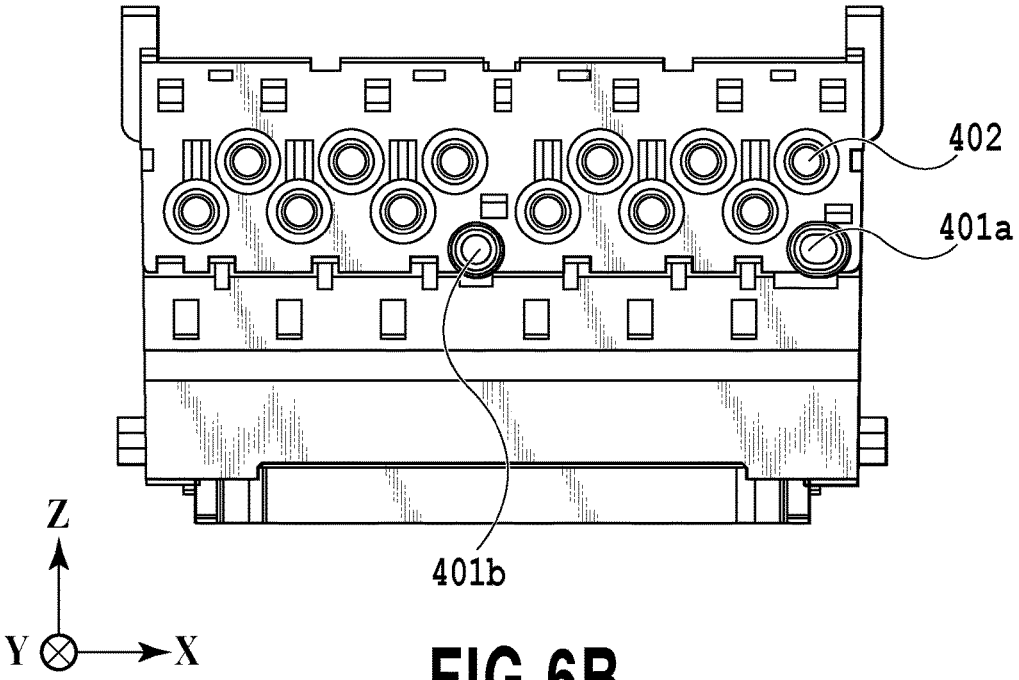
FIG.6B PRIOR ART

At this point, FIGS. 6A and 6B will be referenced again to compare the layout of the exemplary embodiment to that of Japanese Patent Laid-Open No. 2012-45805. In Japanese Patent Laid-Open No. 2012-45805, the positioning pins 301*a* and 301*b* and the positioning openings 401*a* and 401*b* are disposed farther in the −Z direction than the joint needles 302 and the joint openings 402. In other words, the positioning pins 301*a* and 301*b* and the positioning openings 401*a* and 401*b* are positioned closer to the joint seal interposed between the ejecting head and the sub tank than the joint needles 302 and the joint openings 402. In contrast, the positioning pins 501 and 502 and the positioning openings 111 and 112 of the exemplary embodiment are arranged at positions farther away from the joint seal than the joint needles 213 and the joint openings 180.

In the inkjet printing apparatus of the exemplary embodiment, referring to FIG. 1, after mounting and affixing the IJ head 100 to the carriage 310, the joint needle unit 500 to which the tubes are coupled is connected to the joint cover 140. For this reason, the force in the Y direction produced due to the insertion of the joint needles 213 becomes a resistance from the carriage 310, which is imparted internally in the IJ head 100. In a configuration in which the ejecting head unit 110 and the sub tank units 150 are stacked and coupled together like in the exemplary embodiment, the vicinity of the connection face including a component parallel to the insertion direction, or in other words the joint seal, becomes the location that is most susceptible to the effects of the resistance. However, if the layout configuration of the exemplary embodiment as described in FIGS. 3A and 3B is adopted, the effects of the resistance at the connection face may be minimized.

Figure 5A:
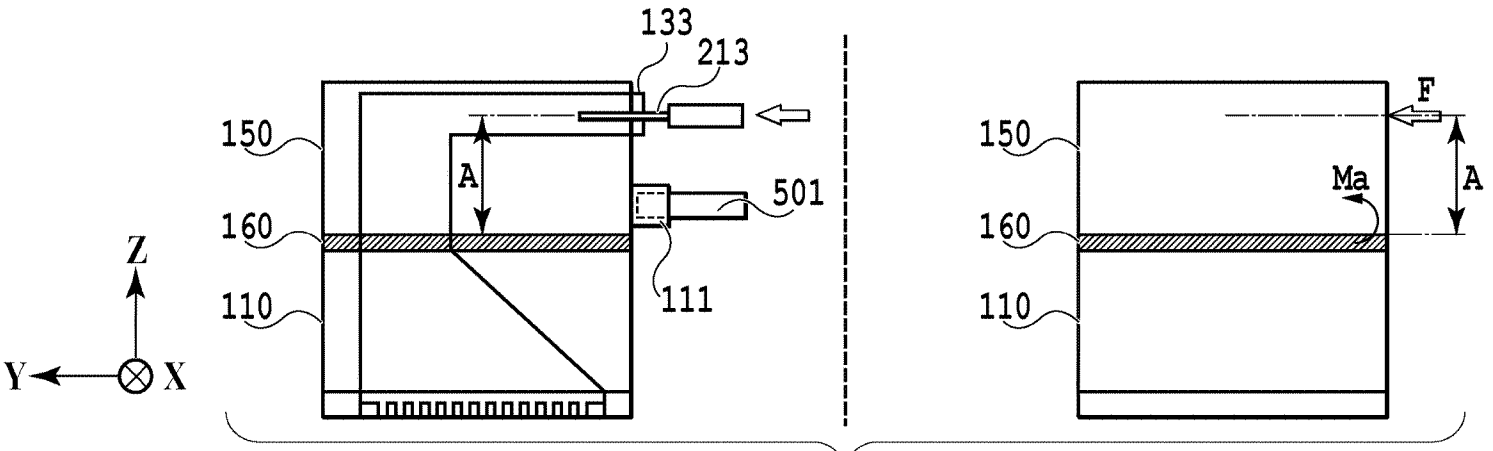
FIGS. 5A and 5B are diagrams for explaining the operational advantages of an exemplary embodiment.
Figure 5B:
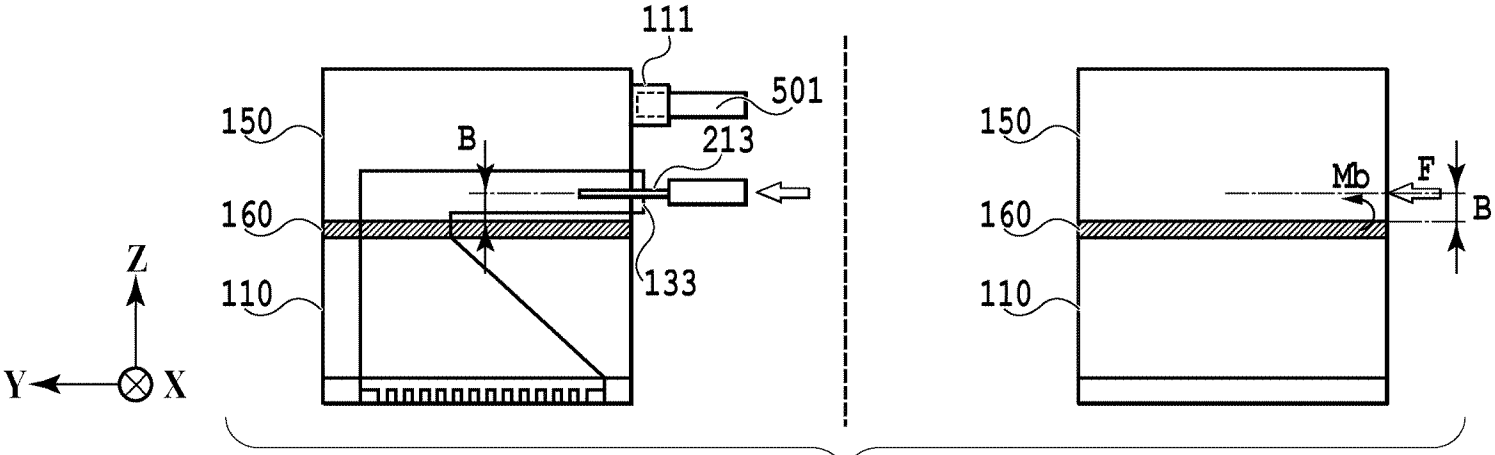

FIGS. 5A and 5B are diagrams for explaining the function effect gained by adopting the layout configuration of the exemplary embodiment. FIG. 5A illustrates a state in which the coupling between the joint needle 213 and the needle seal 133 is farther away from the joint seal 160 in the Z direction than the coupling between the positioning pin 501 and the positioning opening 111. On the other hand, FIG. 5B illustrates a state like in the exemplary embodiment, in which the coupling between the joint needle 213 and the needle seal 133 is closer to the joint seal 160 in the Z direction than the coupling between the positioning pin 501 and the positioning opening 111.

When the joint needle 213 is inserted, a force F is produced in the Y direction due to friction. Such force F produces a moment of force M that attempts to rotate the sub tank unit 150 fixed in the carriage 310. This moment of force M readily affects the weakest portion of the components, namely, the coupling between the ejecting head unit 110 and the sub tank unit 150.

For this reason, if at least a certain moment of force M is maintained for a certain period, there is a risk that the sub tank unit 150 will be pulled away from the joint seal 160, the sealing action of the joint seal 160 will be lost, and air may intrude into the ink supply channels or ink inside the supply channels may leak out. Furthermore, if air intrudes into the ink supply channels, the ink supply may become discontinuous and normal ejecting operations may not be performed, leading to image degradation. In addition, if such an air leak occurs, it is difficult to completely remove the intruding air even if an ejecting head recovery process is performed by a maintenance unit provided in the main apparatus, leading to increased concerns about the need to replace the IJ head 100 itself.

However, the magnitude of the moment of force M received by the coupling depends on the distance in the Z direction from the coupling (that is, the joint seal 160) to the joint needle 213. In other words, by decreasing the distance from the joint seal 160 to the joint needle 213 compared to the past like in the exemplary embodiment (B<A), the moment of force (Mb=FB) may be made smaller compared to the past (Ma=FA). As a result, the risk of loss of the seal action by the joint seal 160 and concerns about air intrusion and ink leakage may be reduced.

In other words, according to the exemplary embodiment, in a configuration that couples a joint needle unit supporting multiple joint needles to a sub tank, the positions of the joint needle couplings are placed as close to the joint seal as possible. Consequently, even if external force is produced due to coupling, the force exerted on the weakest portion of the IJ head may be minimized.

Note that although the ejecting head unit 110, the sub tank unit 150, and the joint seal 160 are joined by being screwed together in the above, the joining method is not limited to the above configuration. These three members may also be joined via an adhesive agent or by welding. Also, it is not strictly necessary to provide the joint seal 160 as a separate member.

Furthermore, in the exemplary embodiment described above, two sub tank units 150, two joint seals 160, and two joint covers 140 are provided with respect to one ejecting head unit 110, but the present invention is not limited to such a configuration. A configuration in which one sub tank unit 150, one joint seal 160, and one joint cover 140 are provided is also acceptable, and a configuration in which three or more of each are provided is also acceptable. Furthermore, multiple ejecting head units may also be provided.

Moreover, the present invention still functions effectively for an ejecting head that ejects ink of only one color. In this case, the number of sub tank liquid chambers and the number of joint needles inserted into the sub tank become one each.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-104548, filed May 22, 2015, which is hereby incorporated by reference herein in its entirety.

What is claimed is:

1. A liquid ejecting head removably attachable to a printing apparatus provided with joint needles for flow of a fluid and positioning members for positioning, at least some of the joint needles being for supply of liquid as the fluid, the liquid ejecting head comprising:

an ejecting head unit configured to eject liquid; and a sub tank unit configured to connect to the ejecting head unit at a first face of the sub tank unit and supply liquid to the ejecting head unit through the first face, wherein a plurality of joint openings that accepts insertion of the joint needles and that corresponds to all of the joint needles and a plurality of positioning openings that engages with the positioning members are provided on a second face of the sub tank unit, the second face intersecting with the first face, a distance from each of the positioning openings to the first face is longer than a distance from each of the joint openings to the first face, and each of the positioning openings is located at an end of the second face distal to the first face.

2. The liquid ejecting head according to claim 1, wherein the first face lies along an insertion direction in which the joint needles are inserted into the joint openings of the second face.

3. The liquid ejecting head according to claim 1, wherein the ejecting head unit is capable of ejecting a plurality of types of liquid, and the joint needles are provided, respectively, for each of the plurality of types of liquid.

4. The liquid ejecting head according to claim 1, wherein a plurality of the sub tank units are connected to the ejecting head unit.

5. The liquid ejecting head according to claim 1, wherein at the first face, an opening part of the ejecting head unit and an opening part of the sub tank unit are connected by being screwed together.

6. The liquid ejecting head according to claim 1, wherein at the first face, an opening part of the ejecting head unit and an opening part of the sub tank unit are connected by an adhesive agent or by welding.

7. The liquid ejecting head according to claim 1, wherein the positioning openings are located on the second face and are furthest from the first face.

8. A liquid ejecting apparatus including a liquid ejecting head removably attachable to a printing apparatus provided with joint needles for flow of a fluid and positioning members for positioning, and a carriage on which the liquid ejecting head is mounted, at least some of the joint needles being for supply of liquid as the fluid, the liquid ejecting head comprising:

an ejecting head unit configured to eject liquid; and a sub tank unit configured to connect to the ejecting head unit at a first face of the sub tank unit and supply liquid to the ejecting head unit through the first face, wherein a plurality of joint openings that accepts insertion of the joint needles and that corresponds to all of the joint needles and a plurality of positioning openings that engages with the positioning members are provided on a second face of the sub tank unit, the second face intersecting with the first face, a distance from each of the positioning openings to the first face is longer than a distance from each of the joint openings to the first face, each of the positioning openings is located at an end of the second face distal to the first face, and by causing the carriage to move relative to a print medium while causing the liquid ejecting head to eject ink according to print data, an image is printed onto the print medium.

* * * * *